US009046086B2

(12) United States Patent
Schwing et al.

(10) Patent No.: US 9,046,086 B2
(45) Date of Patent: Jun. 2, 2015

(54) METHOD FOR FEEDING PASTY MASSES AND PUMP DEVICE FOR FEEDING PASTY MASSES

(76) Inventors: Friedrich Schwing, Gelsenkirchen (DE); Stefan Schwing, Bochum (DE)

( * ) Notice: Subject to any disclaimer, the term of this patent is extended or adjusted under 35 U.S.C. 154(b) by 39 days.

(21) Appl. No.: 13/144,791

(22) PCT Filed: Jan. 14, 2010

(86) PCT No.: PCT/EP2010/000161

§ 371 (c)(1),
(2), (4) Date: Jul. 15, 2011

(87) PCT Pub. No.: WO2010/081695

PCT Pub. Date: Jul. 22, 2010

(65) Prior Publication Data

US 2011/0274572 A1 Nov. 10, 2011

(30) Foreign Application Priority Data

Jan. 16, 2009 (DE) ..... 10 2009 005 318

(51) Int. Cl.
*F04B 7/00* (2006.01)
*F04B 15/02* (2006.01)
*F04B 11/00* (2006.01)

(52) U.S. Cl.
CPC ..... *F04B 15/023* (2013.01); *F04B 7/0023* (2013.01); *F04B 7/0026* (2013.01); *F04B 11/0058* (2013.01); *F04B 15/02* (2013.01)

(58) Field of Classification Search
USPC ..... 417/53, 516, 515
See application file for complete search history.

(56) References Cited

U.S. PATENT DOCUMENTS

| | | | | |
|---|---|---|---|---|
| 3,580,696 | A * | 5/1971 | Schwing | 417/515 |
| 3,663,129 | A | 5/1972 | Antosh | |
| 3,741,691 | A * | 6/1973 | Schwing | 417/517 |
| 3,963,385 | A | 6/1976 | Caban | |
| 5,216,363 | A | 6/1993 | Masaaki | |
| 5,316,453 | A | 5/1994 | Schwing | |
| 6,206,662 | B1 | 3/2001 | Schwing | |

(Continued)

FOREIGN PATENT DOCUMENTS

| | | |
|---|---|---|
| CN | 1260029 A | 7/2000 |
| CN | 1265724 A | 9/2000 |

(Continued)

OTHER PUBLICATIONS

Translation of JP58-35680, 1983.*

*Primary Examiner* — Christopher Bobish
(74) *Attorney, Agent, or Firm* — Howard IP Law Group, PC

(57) ABSTRACT

A method for feeding pasty masses using a pump device which has a piston pump with at least two cylinders, each having one piston, is disclosed. Each cylinder of the pump device is connected to a pre-fill container via an inlet opening and to a feed line via an outlet opening. Pasty mass is fed from the pre-fill container into the respective cylinder during a suction stroke of a cylinder with the inlet opening open and the outlet opening closed, and pasty mass is fed into the feed line during a pump stroke of a cylinder with the outlet opening open and the inlet opening closed. The piston velocity is greater during the suction stroke than during the pump stroke. Near or at the end of the suction stroke, the inlet opening is closed, whereafter the pasty mass is compressed in the cylinder before the outlet opening is opened.

8 Claims, 4 Drawing Sheets

(56) References Cited

U.S. PATENT DOCUMENTS

| | | | | |
|---|---|---|---|---|
| 6,450,779 | B1 * | 9/2002 | Schwing | 417/317 |
| 2006/0193738 | A1 * | 8/2006 | Schwing et al. | 417/523 |
| 2007/0196224 | A1 | 8/2007 | Lenhart | |
| 2008/0260560 | A1 * | 10/2008 | Lenhart | 417/516 |

FOREIGN PATENT DOCUMENTS

| | | | |
|---|---|---|---|
| DE | 42 08 154 | | 9/1992 |
| DE | 42 08 754 | | 9/1993 |
| DE | 195 03 986 | | 8/1996 |
| DE | 102 40 256 | | 3/2004 |
| DE | 10343802 | A1 | 4/2005 |
| DE | 10 2005 008 938 | | 1/2007 |
| EP | 0 057 288 | | 8/1982 |
| EP | 1 003 909 | | 5/2000 |
| EP | 1 003 969 | | 5/2000 |
| JP | 35-009965 | | 5/1960 |
| JP | 56035680 | | 3/1981 |
| JP | 58-35680 | | 3/1983 |
| JP | S59208177 | A | 11/1984 |
| JP | S6047885 | A | 3/1985 |
| JP | S60133163 | A | 7/1985 |
| JP | S61-93282 | | 5/1986 |
| JP | H03-149360 | | 6/1991 |
| WO | WO99/01577 | | 7/1997 |

* cited by examiner

METHOD FOR FEEDING PASTY MASSES AND PUMP DEVICE FOR FEEDING PASTY MASSES

CROSS-REFERENCES TO RELATED APPLICATIONS

This application is the U.S. National Stage of International Application No. PCT/EP2010/000161, filed Jan. 14, 2010, which designated the United States and has been published as International Publication No. WO 20101081695 and which claims the priority of German Patent Application, Serial No. 10 2009 005 318.2, filed Jan. 16, 2009, pursuant to 35 U.S.C. 119(a)-(d).

BACKGROUND OF THE INVENTION

The invention relates to a method for feeding pasty masses using a pump device which has a piston pump with at least two cylinders, each cylinder having one piston, with each cylinder being connected via an inlet opening to a pre-fill container and with each cylinder being connected via an outlet opening to a feed line. The invention also relates to a pump device for feeding pasty masses with a piston pump having one cylinder, which has a piston and which is connected with a pre-fill container via an inlet opening that can be closed by an inlet slide valve.

When feeding concrete, pump devices are used which are typically constructed from piston pumps having two cylinders, with each cylinder having a piston. The cylinders receive the pasty mass to be transported from a pre-fill container in a so-called suction stroke and then feed the suctioned pasty mass to a feed line connected to the piston pump in a so-called pump stroke. The pistons of the two cylinders are operated in opposite direction in order to feed the pasty mass to the feed line with the greatest attainable uniformity. The feed line of such pump device can have a substantial length. It is frequently part of a crane boom and is used to feed the pasty mass from the location of the pump device to remote ends of the construction site. Due to the length of the feed line, very small interruptions in the feed flow of the pasty mass can already cause significant swinging movements of the feed line due to the mass inertia. It is therefore desirable to develop a method which allows a continuous feed of the pasty mass.

Methods for feeding pasty masses supposedly continuously are known from practical applications. However, when analyzing the feed path of the pasty mass from the interior space of the cylinder, from which it is pressed by the piston, to the outlet end of the feed line, it becomes clear that although these methods used in practice are capable to provide improved uniformity of the transport, the transport is not continuous. Components, in particular valves, are arranged in the feed path of these pump devices, wherein the valve bodies are in a closed position arranged at a position where they displace the pasty mass, whereas in an open position the valve body is removed from the feed space provided for feeding the pasty mass. Accordingly, the feed flow is interrupted during each opening operation. This interruption is filled by the pasty mass which is already downstream of this gap and falls back. This adversely affects the uniform feed of the pasty mass in the feed direction, so that the pasty mass cannot be viewed as being fed continuously.

A truly continuous feed of concrete is achieved with a 2-cylinder piston pump disclosed in DE 42 08 754 A1. However, the opening of the swivel pipe (there: 104) and, on one hand, the slide valve plates (there: 101, 102) attached to the sides thereof and, on the other hand, the so-called orifice plate, on which the opening of the swiveling pipe with the slide valve plates sealingly slides, experience unacceptably high wear. It became clear that switching under load with this arrangement caused the following unsolved problems:

1) The abrasive, fine-grain components of the concrete were pressed during the switching process by the continuously maintained feed pressure into the sealing gaps, where they then produced a high switching resistance of the slide valve which furthermore caused significant wear due to the very long switching paths of the slide valve which is unknown with conventional discontinuous pumps.

2) Point 1) requires a very high drive power, i.e., requires a very high switching power over a longer time.

A continuously feeding 2-cylinder concrete pump with a total of two slide valves was proposed in the patent application which matured into EP 1 003 909 B1, wherein one slide valve switches at "equilibrium pressure" whereas the other slide valve switches at "zero pressure." In the slide valve switching at equilibrium pressure, the same pressure as is permanently present outside the pivoting pipe in the pressure housing and the attached feed line is also produced inside the pivoting pipe before the switching operation by compressing the suctioned concrete. Accordingly, there is no pressure difference between the inside and the outside on the mouth of the pivoting pipe sliding along the inside of the pressure housing. Fine, abrasive components of the concrete are therefore not pressed into the slide gaps by a hydrostatic pressure difference. Instead, a state exists which is very similar to an unpressurized state.

The shutoff valves in the suction line from the pre-fill container to the pivoting pipe only opens the concrete due has relaxed in the suction stroke and closes before compression of the suctioned concrete. This suction slide valve therefore switches without hydrostatic pressure in the concrete ("zero pressure"). These remarkable advantages of the configuration described in EP 1 003 909 B1 are to be contrasted with the following disadvantages:

The pressure housing is very large, and very heavy with a presently typical maximum concrete pressure of about 90 bar, making cleaning very complex. Particularly disadvantageous are the tight bends which the concrete has to traverse during the pump stroke past the suction-swiveling pipe through the concrete residing in the pressure housing on its path to the feed line. This pump is therefore unable tool feed very coarse-grain concrete mixtures. Another disadvantage is that when switching to the other cylinder, the mouth of the swiveling pipe must be accommodated between the two cylinder openings. This necessitates a large center spacing between the two feed cylinders, so that these two cylinders cannot be installed at an angle extending between the side rails of the support vehicle, as would be required for a sufficiently low fill height of the pre-fill container.

DE 10 2005 008 938 B4 also includes a total of 2 slide valves which operate with both feed cylinders. One slide valve is hereby a four-way slide valve with two switch positions switching at "zero pressure", e.g., the swiveling pipe in an open pre-fill container presently used with discontinuous pumps. An additional shutoff gate valve is installed in the feed line which always switches at equilibrium pressure. The substantial improvement of DE 10 2005 008 938 B4 over EP 1 003 909 B1 is, inter alia, that the switching process not only takes place under equilibrium pressure and/or zero pressure, but that an automatic ring can be used at least with the shutoff valve switching at equilibrium pressure, wherein the hydrostatic contact pressure of the automatic ring is compensated by the pressure of the concrete at equilibrium pressure, because the same pressure is present on the outside and the inside on the cutting ring after compression. The contact face of the cutting ring with its sliding partner, the swiveling body, it is therefore also subjected to the pressure of the medium as gap pressure, which exerts on the cutting ring a force of equal magnitude opposing the hydrostatic contact pressure. For the contact pressure during the switching process, ideally only the much smaller and freely selectable bias force of the sealing ring of the automatic ring, which also operates as a spring, remains. The automatic ring therefore operates for the duration of the switching process and during the equilibrium pressure exclusively as a wiper. This reduces friction and hence also wear and minimizes the required drive power for the slide valve.

The configuration disclosed in DE 10 2005 008 938 B4 has the following disadvantages:

The two assemblies required in addition to the normal swiveling pipe are the shutoff slide valve which must be supported in the feed line about 1 m downstream after the swiveling pipe and the equalization cylinder which must be integrated further downstream in the feed line due to space considerations.

The patented equalization cylinder corresponds in the feed capability to two cylinders connected in parallel, wherein the piston stroke is cut in half compared to conventional equalization cylinders (see DE 42 081 54 A1, FIG. 1). Although the driving hydraulic cylinder is also not installed "in series" following the feed cylinders, but between the two, this equalization cylinder takes up so much space that it can only be accommodated with difficulty and adequately secured on an automotive concrete pump. Moreover, the equalization cylinder is an expensive, complicated and very heavy assembly.

With this in mind, it is an object of the invention to propose a method for continuously feeding pasty masses, which is adapted to more uniformly feed the pasty mass. At the same time, a pump device for feeding pasty masses is proposed which seals the inlet opening particularly well.

SUMMARY OF THE INVENTION

The method is based on the concept to provide for each cylinder of the piston pump a dedicated inlet opening with a dedicated inlet slide valve as well as a dedicated outlet opening with a dedicated outlet slide valve. The respective cylinder can then be filled and the pasty mass can be discharged into the feed line by the respective cylinder independent of the operating steps of the other cylinder(s). During the pump stroke of one cylinder, i.e., the continuous feed of pasty mass from the one cylinder into the feed line, another cylinder can be filled, on one hand, with the pasty mass and, on the other hand, the pasty mass can already be pre-compressed in this newly filled cylinder. In particular, a valve body of the outlet slide valve of this newly filled cylinder can then be moved from a closed position into an open position only when the pressure of the pasty mass that is pressurized in the cylinder by compression corresponds substantially to the pressure of the pasty mass in the feed line of the outlet slide valve. This significantly simplifies switching of the outlet slide valve under equilibrium pressure and switching of the inlet slide valve at zero pressure.

To this end, the method of the invention provides that during a suction stroke of a cylinder with the inlet opening open and the outlet opening closed, pasty mass is transported from the pre-fill container into the corresponding cylinder, and during a pump stroke of a cylinder with the outlet opening open and the inlet opening closed, pasty mass is transported into the feed line, the velocity of the piston during the suction stroke is greater than during the pump stroke, at the end, close to the end or shortly after the end of the suction stroke the inlet opening is closed with the inlet slide valve, whereafter the pasty mass is compressed in the cylinder before the outlet opening is opened.

With this method, the individual inlet and outlet slide valves can be switched under particularly advantageous conditions.

With the method according to the invention, the respective inlet slide valve can be closed at a time when the pasty mass suctioned into the cylinder during the suction stroke has the same pressure as the pasty mass residing in the pre-fill container. This results in an essentially unpressurized situation of the concrete in the region of the pre-fill container and the just filled cylinder, which is referred to for sake of simplicity as "zero pressure." In addition, the method according to the invention allows opening the respective inlet slide valve only when the corresponding cylinder has started its suction stroke. In a preferred embodiment of the method of the invention, by opening the inlet slide valve of the corresponding cylinder only when the cylinder has started its suction stroke, the pressure of the pasty mass which still resides in the cylinder at the end of the pump stroke and after the outlet slide valve is closed decreases until it reaches the pressure of the pasty mass in the pre-fill container. The inlet slide valve can then be opened in any situation where a pressure difference no longer exists between the pre-fill container and the content of the cylinder. This allows a simple construction of the inlet slide valve. Very short flat gate valves without pressure equalization can be used. These can be particularly well sealed with an automatic ring, as is provided as part of the pump device according to the invention.

With the method of the invention, the outlet slide valve can be closed in a state where the pasty mass in front of the cylinder and the pasty mass in the feed line have the same pressure. This state, where the pasty mass in front of a slide valve and the pasty mass after a slide valve have identical pressure, meaning that the slide valve is in an environment of equal pressure, is referred to for sake of simplicity as "equilibrium pressure."

According to the method of the invention, before the outlet slide valve is opened, the pasty mass suctioned during the suction stroke into a cylinder is compressed to the actual feed pressure through compression against the closed inlet slide valve and against the closed outlet slide valve of this cylinder. A situation with equal pressure is then generated before the outlet slide valve is opened. In a preferred embodiment, this situation of equal pressure advantageously also allows the use of an automatic ring on the valve body of the outlet slide valve or on the outlet opening of the outlet slide valve which is closed by the valve body. The equilibrium pressure situation produces a situation resembling zero pressure. With an automatic ring provided on the outlet opening that is closed by the valve body of the outlet slide valve, the contact surface between the automatic ring and the swiveling body is pressurized by the pasty mass (in particular with cement paste, i.e. the liquid components of the concrete) through compression of the suctioned concrete also from the outside. The hydrostatic contact pressure of the automatic ring is then compensated by the opposing force of the gap pressure of identical magnitude. The automatic ring is then pressed during the switching process, similar to the situation during zero pressure, with equilibrium pressure only from the freely selectable, low pre-bias of a springy sealing ring. The automatic ring then operates only as a wiper, thereby reducing the swiveling resistance and the wear to a minimum.

With the method of the invention, both on the inlet slide valve and on the outlet slide valve, the hydrostatic contact pressure of the automatic ring required for preventing lifting during difference pressure is produced only at rest after the switching operation and when pressure differences occur on the closed slide valve.

With the method of the invention, a pump device can be used which can be constructed with only insignificantly greater complexity compared to discontinuous pumps by employing two inlet slide valves, which would be not required for a discontinuous pump having two rotary slide valves. For example, the two inlet slide valves provided in the pre-fill container can be configured to be pivotable along the housing wall of the pre-fill container. The pump device used with the method of the invention can be compact, inexpensive and lightweight. The overall length and the fill height on the pre-fill container can be kept identical to those of conventional discontinuous pumps with swiveling pipe. The wear on the slide valves can be kept very small in the zero-pressure situation or in a situation similar to zero pressure ("equilibrium pressure"), in spite of also maintaining the feed pressure. The switching resistances of the slide valves and the required switching power as well as the required switching duration can be kept small. The slide valves to be used with the method of the invention can additionally have very small movable masses. This is particularly advantageous in view of the large number of switching operations which must be performed within a short time due to the very tight time schedule.

Advantageously, a pump device which obviates the need for the swiveling pipe known from EP 1 003 969 B1 can be employed with the method of the invention. This is particularly advantageous when feeding pasty mass with a high fraction of broken grain which may cause so-called bridge formation in the pre-fill container. With this type of the pasty mass, the so-called pipe switching pumps (pumps with a swiveling pipe, as illustrated for example in EP 1 003 969 B1) represent a regression from pumps with flat gate valves. With the method of the invention, flat gate valves can be employed. If the swiveling pipe, which requires a large space in the pre-fill container for its movement, can be eliminated, then a powerful agitator can be installed which is also effective in the critical region of the inlet openings. The inventor has observed that the swiveling pipes in the pre-fill container create with their movement hollow spaces and prevent their effective destruction.

In a preferred embodiment of the invention, an outlet slide valve configured as a rotary slide valve is used. The term rotary slide valve refers to slide valves which can be rotated from a closed position into an open position inside the space provided by the slide valve housing, without the valve body of the slide valve leaving the space defined by the slide valve housing. As an alternative to rotary slide valves, linear flat gate valves and so-called plunger slide valves with cylindrical closure elements, wherein a valve body is moved linearly from an opening position arranged on the side of the space defined by the slide valve housing into the space defined by the slide valve housing in order to assume its closed position. Rotary slide valves can be particularly advantageously employed when changing from a closed position into an open position without a change in volume, meaning that during movement of the valve body from the closed position into the open position and back into the closed position no gap or excess quantity is produced in the pasty mass surrounding the valve body both upstream and downstream when moving the valve body from the closed position into the open position and back into the closed position.

In a particularly preferred embodiment of the method of the invention, an outlet slide valve in form as a rotary slide valve with a valve body in a slide valve housing is employed, wherein the slide valve housing is part of the feed space, wherein the pasty mass is transported from the respective cylinder into the feed line and the valve body remains in the slide valve housing in all positions of the outlet slide valve.

With this configuration, the valve body can be moved from the closed position into the open position and back without a volume change. This aids the continuous feed of the pasty mass, because no gap is produced in the feed space when the closure body leaves the pressure space during opening. Conversely, the closure body would significantly increase the effective feed quantity when moving into the pressure space, so that continuity could also not be achieved.

In a preferred embodiment of the method of the invention, the valve body of the outlet slide valve is moved from a closed position into an open position, when the pressure of the pasty mass in the cylinder, to which compressive pressure is applied, substantially corresponds to the pressure of the pasty mass on the feed-line-side of the outlet slide valve. This produces an equal pressure situation which enables particularly easy switching of the outlet slide valve with reduced wear.

In a particularly preferred embodiment of the method of the invention, an inlet slide valve configured as a flat pivoting valve is used. With a flat pivoting valve, the flat valve body of the slide valve is pivoted with a pivoting motion from an opening position arranged on a side next to the opening to be closed into a closed position which closes the opening to be closed. Such flat pivoting valves can have a very simple structure. With the method of the invention, the inlet slide valves can be opened in a zero pressure situation, so that a flat pivoting valve of simple design can be used, which can be switched while or after the pressure is relieved. In particular, the pivoting resistance would be practically insurmountable and the wear extremely high with high feed resistances in the feed line.

In particular, the method according to the invention can be operated as follows:

1. With the inlet opening open and the outlet opening closed, the piston of a cylinder is pulled backward for performing a suction stroke. The pasty mass is hereby suctioned into the cylinder from the pre-fill container.
2. At the end, close to the end or shortly after the end of the suction stroke, the inlet opening is closed by pivoting the inlet slide valve into its closed position. The selection if closing the inlet opening is performed at the end, near the end or shortly after the end of the suction stroke is mainly determined by the system. For example, it may be necessary due to the switching times of the inlet slide valve to begin the pivoting motion of the inlet slide valve into the closed position already before the piston has reached its fully retracted position in the cylinder. On the other hand, the inertia of a potentially employed hydraulic switching system may cause the inlet slide valve to be closed only after the end position sensors have detected that the piston has reached its end position in the cylinder.
3. The piston of the cylinder is moved towards the outlet opening and the inlet opening and thereby compresses the pasty mass in the cylinder.
4. The outlet opening is opened by pivoting the outlet slide valve. The associated feed cylinder is now ready for pumping.
5. After a short reserve time interval (for the actual pumping of the pasty mass), the pumping piston reaches approximate its end position. The hydraulic component of is now preferably switched such that the oil flow in the hydraulic system controlling the valves can be briefly divided over two cylinders. The effective transported quantity of concrete remains hereby constant. After reaching the end position, only the following cylinder feeds. Complete continuity can be achieved in this manner.

6. At the end or near the end of the pump stroke, the outlet opening is closed by pivoting the outlet slide valve into its closed position.

This switching operation takes place under equilibrium pressure, thereby achieving small switching resistances and low wear.

7. The piston is retracted into the cylinder, thereby relaxing the pasty mass still residing in the cylinder and in the control housing. The inlet slide valve is pivoted into its opening position when the pressure of the pasty mass inside the cylinder corresponds to the pressure in the pre-fill cylinder.

The additional cylinder is operated in the opposite direction, wherein the steps 1 to 4 of the movements of the one cylinder are performed entirely during the time when the piston of the other cylinder feeds pasty mass into the feed line with the actual feed pressure. The velocity of the piston during the suction stroke should here be selected to be greater than the velocity during the pump stroke in order to keep the time for performing the steps 1 to 4 to a minimum. This match of the individual steps to each other causes the pasty mass to be pumped continuously into the feed line. As soon as the pump stroke of one cylinder has ended, the other cylinder with pre-compressed pasty mass is available to continue the feed.

In an alternative embodiment of the method according to the invention for feeding pasty masses, a pump device is employed which has a piston pump with at least two cylinders, each cylinder having a piston, wherein each cylinder is connected with a pre-fill container via an inlet opening that can be closed with a inlet slide valve associated with the cylinder, and wherein each cylinder is connected with a feed line via an outlet opening that can be closed with an outlet slide valve associated with the cylinder. With this method, a cleaning body is introduced into at least one of the cylinders, wherein the cleaning body is introduced through the open outlet slide valve into the feed line with compressed air or high-pressure water and transports the pasty mass residing in the feed line through the feed line. This alternative embodiment is advantageous in combination with the aforedescribed embodiment of the method of the invention.

With the alternative embodiment, the pump device can be easily cleaned. In addition to the problem with the discontinuity, there is also a problem relating to disposal of the residual concrete. If the piston pump suctions air instead of concrete, feeding is no longer possible. The concrete remaining in the filled feed line on the distribution boom and the concrete still residing in the pre-fill container, which can no longer be suctioned in, is referred to as "residual concrete." The concrete from the fill line is in practice suctioned back into the pre-fill container with a "wiper wall" with the aid of gravity. For longer booms, the pre-fill container overflows, requiring significant cleaning.

The design of the pump device to be used with the method according to the invention with preferably two inlet slide valves which are reliably sealed with automatic rings and can be switched independently allows to suction a respective ball through both suction openings and feed the balls into the two legs of an optionally provided Y-branch pipe, thereby feeding the entire concrete with compressed air up to the application site. The compressed air pushes the cleaning body, preferably the ball, through the feed line.

The pump device according to the invention for feeding pasty masses includes a piston pump with one cylinder which has a piston and is connected with a pre-fill container via an inlet opening that is delimited by an orifice plate and can be closed with an inlet slide valve, wherein the inlet slide valve has a closure surface facing the inside of the slide valve housing, wherein the inlet slide valve has a pivotable base body, the closure surface is formed at least partially by the surface of a piston that is movable relative to the base body, wherein the piston can enter a closed hollow space formed in the base body when a pressure from a medium is applied to the piston from inside of the slide valve housing, a fluid which can be compressed when the piston enters is provided in the hollow space, a cutting ring constructed as an annular piston is provided which has a surface facing the hollow space and which is pressed in the closed position of the inlet slide valve against the orifice plate by the pressure of the fluid.

With this design of an inlet slide valve, a flat swivel slide valve with a cutting ring (automatic ring) can be provided, although the media does not flow through the cutting ring as is the case in EP 0 057 288 A1. A particular advantage of this flat swivel slide valve is its very flat structure, which provides an optimal effect of the agitator also in front of the suction openings.

The switching process which occurs for the inlet slide valve essentially in an approximately unpressurized state ("zero pressure"), the cutting ring is only pressed against the corresponding sealing surface as a wiper with the freely selectable pre-bias of a biasing spring. The wear of such cutting ring can thus be reduced, because it wears almost exclusively during the switching operation with the third power of the contact pressure.

A particular characteristic of such arrangement with an inlet slide valve is that the pre-fill container is normally under ambient pressure on one side of the inlet slide valve. With the proposed structure, the pasty mass can be "deflected" to the side of the cutting ring facing away from the pasty mass by the force produced by the pressure of the hollow space which borders adjacent movable element as well as the cutting ring. In the closed position of the inlet slide valve, the pasty mass applies pressure on the outwardly oriented surface of the movable part. This pressure is transmitted to the fluid in the hollow space via the inwardly oriented surface. This—preferably incompressible—fluid applies pressure on the outwardly oriented face of the cutting ring and thereby presses the cutting ring onto the sealing face surrounding the inlet opening. If pasty mass enters between the cutting ring in the associated sealing face when the pressure from the medium is applied, then the cutting ring is subjected to the gap pressure of the pasty mass, which is on average about 50% of the pressure from the medium, in a direction away from the sealing face. Because the cutting ring is simultaneously also pressed against the sealing face by the fluid in the hollow space with the pressure of the pasty mass, the pressing force in the direction against the orifice plate dominates. The cutting ring is therefore successfully prevented from being lifted from the sealing face. The pressing force is furthermore increased by the additional pre-bias from the spring element. During the switching operation, which occurs on the inlet slide valve at "zero pressure", the pre-bias allows the cutting ring to function as a wiper.

The orifice plate is either constructed in one piece on the pre-fill container or as a separate component. The term "orifice plate" does not define a certain geometry, but merely indicates the faces against which the automatic ring (cutting ring) is sealingly pressed.

In a preferred embodiment, the inlet slide valve has a pre-biased spring element which operates on the piston in the same direction as the pressure from the medium. This produces a pre-bias.

In a preferred embodiment, the spring element is formed as a disc spring or is formed by several disc springs. Disc springs are particularly well-suited for installation in the inlet slide valve constructed according to the invention.

In a preferred embodiment, the piston has on its side facing the fluid a substantially cylindrical shaft which is slidingly supported in a cylindrical bore of the base body and which, in conjunction with the envelope of the piston, forms a guide which secures the piston against canting.

In a preferred embodiment, the shaft of the piston sealingly extends through the base body and is axially movable therein. In this way, the actual position of the piston can be observed from the pre-fill container. This indicates wear on the cutting ring and the orifice plate and/or the correct quantity of the introduced fluid.

In a preferred embodiment, the spring element is supported on the cutting ring.

In a preferred embodiment, the cutting ring is constructed as an annular piston with a U-shaped annular cross-section, wherein the cutting ring is slidingly sealed with its outer inside diameter against the base body and with its inner inside diameter against the piston.

In a preferred embodiment, the hydrostatic force applied on the closed flat slide valve by the pressure of the medium residing inside the cylinder is partially taken up by the pulling force of a pivot shaft supporting the inlet slide valve and partially by a force with which the base body with which is partially guided in a guide groove is supported on the guide groove.

In a preferred embodiment, the inlet slide valve is connected with a pivot shaft, and the connection of the base body with a pivot shaft allows a small pendulum motion about an axis extending essentially horizontal and perpendicular to the pivot axis.

In a preferred embodiment, the spring element is tensioned by introducing the fluid into the hollow space, wherein the piston moves against the effective direction of the pressure from the medium and the fluid space is secured against fluid leakage by a check valves or a stopper.

In a preferred embodiment, the inlet slide valve is a pivoting flat slide valve.

In a preferred embodiment, the inlet slide valve has a spring element which presses a component of the inlet slide valve into the hollow space in such a way that the fluid in the hollow space is pre-compressed. This produces a pressurized situation which holds the components of the inlet slide valve in a first operating situation. In addition, this pre-bias can be used to adjust the pressure with which the cutting ring is pressed against the sealing face.

In a preferred embodiment, grease or oil is used as a fluid. It has been observed that grease or oil is particularly suited for applying pressure to the cutting ring in an operating environment where pasty masses are fed.

In a preferred embodiment, the spring element is implemented as a disc spring. It has been observed that using a disc spring permits a particularly flat design of the inlet slide valve in the pump device according to the invention.

In a particularly preferred embodiment, the movable element, which can apply a pressure to the fluid in the base body corresponding to the pressure applied to the movable element by the pasty mass, is pushed by the spring element into the hollow space, thereby pre-compressing the fluid in the hollow space. In this way, the inlet slide valve can be constructed from a small number of components.

In a particularly preferred embodiment, the hollow space is formed by a recess in the base body which is open in the base body towards the side of the inlet slide valve facing the cylinder and which has a round opening with an opening diameter that is greater than the diameter of the inlet opening, the opening of the recess is closed with a cover and with the cutting ring arranged between the outside periphery of the cover and the wall delimiting the opening for forming the hollow space.

This design simplifies assembly of the inlet slide valve of the pump device according to the invention.

In a preferred embodiment, the cover is movable relative to the base body and forms the movable element. With this design, the inlet slide valve can be easily assembled from a small number of components.

In a particularly advantageous embodiment, the cover has a limit stop which contacts a limit stop of the cutting ring when the cover is urged outwardly by the fluid in the hollow space. The cover is securely held in the inlet slide valve through cooperation of the two limit stops. As a result of the contact, the cutting ring is held on the wall delimiting the opening, so that the cover can be supported by a stop on the cutting ring.

In an alternative embodiment, the cover is attached on the base body and has an opening in which the movable element, for example a piston, is arranged for movement relative to the cover. This may increase the number of components of the inlet slide valve compared to the previous design. However, this design results in a more stable inlet slide valve.

In a preferred embodiment of the pump device according to the invention, the pump device has at least two, in particular exactly two cylinders, each having a piston. Each piston in this preferred embodiment is connected to a pre-fill container via an inlet opening that can be closed with an inlet slide valve associated with the piston. Each cylinder of the preferred embodiment is also connected with a feed line via an outlet opening that can be closed by an outlet slide valve associated with the cylinder. With this embodiment, the feed line can advantageously be easily cleaned. In practice, complex so-called chamber slide valves are employed to eliminate residual concrete when the feed line is blown out, i.e., the feed line is cleaned. The preferred embodiment of the pump device according to the invention can be configured such that the slide valves can be individually controlled, so that a conventional foam rubber ball can be suctioned into each cylinder from the pre-fill container and introduced into the Y-branch pipe provided as part of the feed line and the additional feed line arranged downstream. These foam rubber balls can then be blown out of the front end of the feed line. This significantly simplifies cleaning of such pump device.

In a preferred embodiment, the method according to the invention is carried out with the pump device according to the invention. The pump device according to the invention and the method according to the invention are preferably used for feeding concrete and other pasty materials, such as sludge or debris from tunnel construction.

BRIEF DESCRIPTION OF THE DRAWING

The invention will now be described in more detail with reference to the drawing which illustrates only an exemplary embodiment of the invention. It is shown in.

DETAILED DESCRIPTION OF PREFERRED EMBODIMENTS

Figure 1:
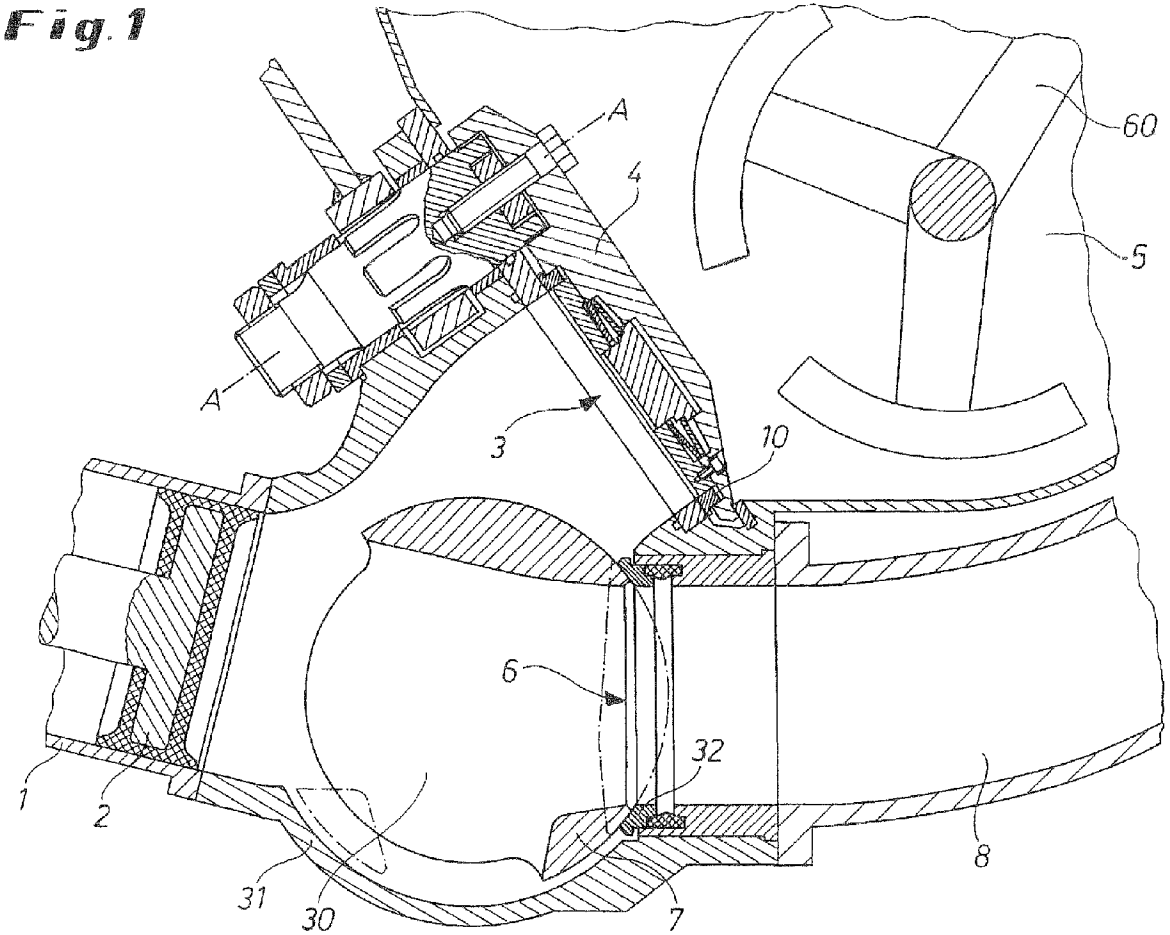
FIG. 1 a cross-sectional side view of a part of the pump device according to the invention, showing the inlet slide valve, the outlet slide valve, the slide valve housing, a part of one cylinder, parts of the feed line and parts of the pre-fill container.

The pump device illustrated in FIG. 1 for feeding pasty masses includes a piston pump with two cylinders, with only one cylinder 1 of the piston pump illustrated in FIG. 1. The cylinder has a piston 2 which is here in its end position. The cylinder is connected with a pre-fill container 5 by way of an inlet opening 3 which can be closed by an inlet slide valve 4. In addition, the cylinder has an outlet opening 6 which can be closed by an outlet slide valve 7. The cylinder 1 is connected via the outlet opening 6 with a feed line 8. The region of the feed line 8 adjacent to the piston pump is constructed as a so-called "Y-branch pipe", meaning as a branched pipe, which combines the feed flows from the individual cylinders of the piston pump and feeds them to an (unillustrated) part of the feed line, where the individual partial flows from the individual cylinders of the piston pump are commonly fed.

The inlet slide valve 4 of the pump device is constructed as a flat pivoting slide valve and can be pivoted about the pivot axis A from the illustrated closed position into an opening position. The inlet slide valve 4 has an automatic ring 10 constructed as a cutting ring, which encompasses the inlet opening 3 in the closed position of the inlet slide valve and is pressed at least with portions of an outwardly oriented face against a sealing face of the body which surrounds the inlet opening and in which the inlet opening is formed.

The outlet slide valve illustrated in its open position is embodied as a rotary slide valve. The valve body 30 of the outlet slide valve is arranged in a slide valve housing 31, wherein the slide valve housing 31 represents the feed space through which the pasty mass is suctioned from the pre-fill container by the respective cylinder and fed to the feed line during the pump stroke. The valve body 30 remains inside the slide valve housing in all positions of the outlet slide valve and can hence be switched without changing volume.

An automatic ring 32 surrounds the outlet opening 6. This automatic ring 32 can be constructed like a cutting ring which is described in detail in EP 0 057 288 A1 (and designated therein with the reference symbol 14), wherein the cutting ring is illustrated in EP 0 057 288 A1 as part of the component to be pivoted (there the switching member 3), whereas here the cutting ring is preferably configured as part of a stationary component of the pump device. Alternatively, the cutting ring 32 can be constructed similar to the arrangement of the cutting ring in EP 0 057 288 A1 as part of the valve body 30 to be pivoted.

The pre-fill container includes an agitator 60, which can be constructed as a flat pivoting slide valve due to the small installation height of the valve body of the inlet slide valve 4, such that it is also effective in the critical region of the suction opening.

Figure 2:
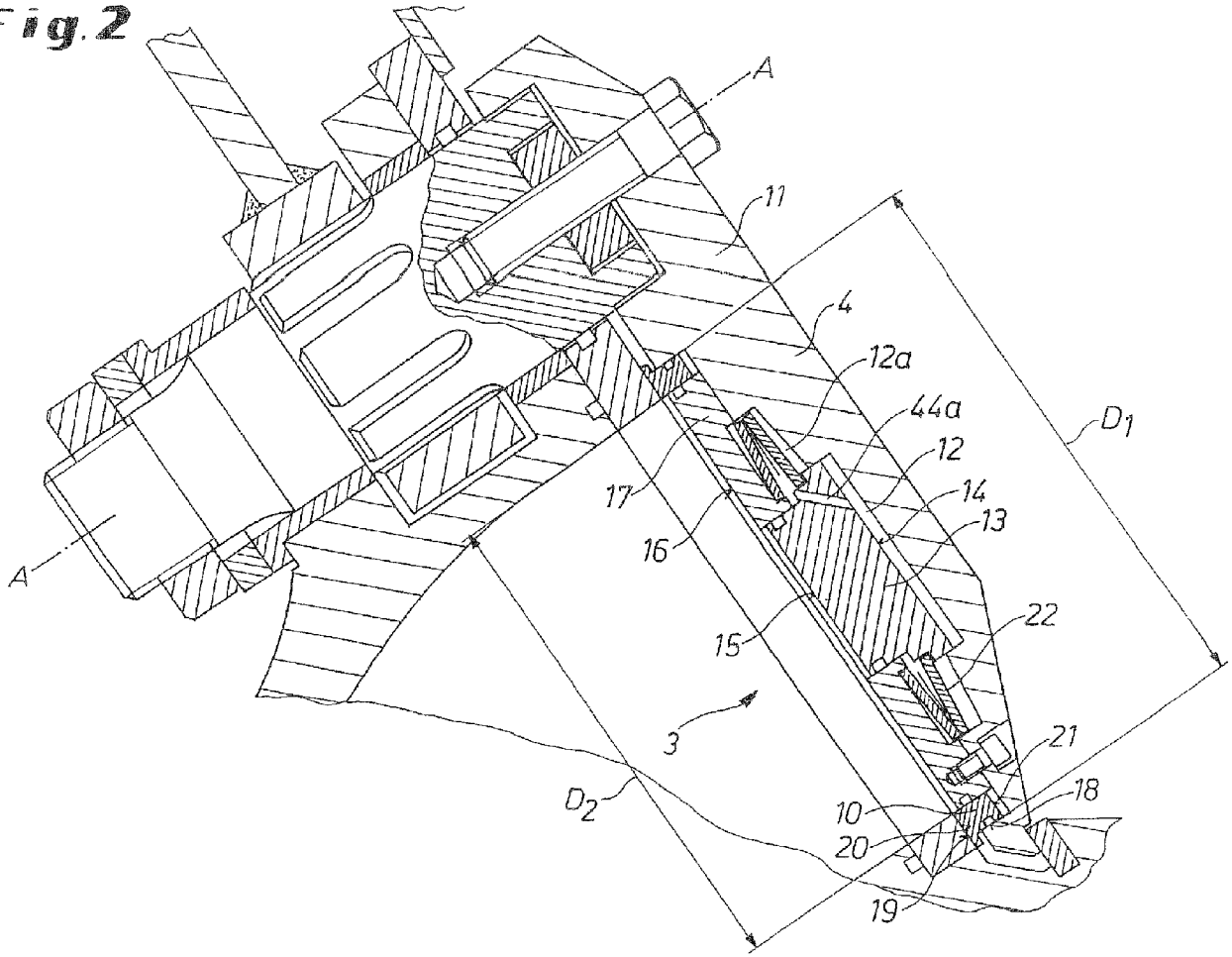
FIG. 2 an enlarged detail of the inlet slide valve in a cross-sectional side view.

The embodiment of the inlet slide valve 4 illustrated in FIG. 2 shows that the inlet slide valve 4 can be formed with a flat base body 11 which can be pivoted about the pivot axis A. The inlet slide valve 4 has an element 13 which is movable relative to the base body 11. This movable element 13 in the embodiment illustrated in FIG. 2 is implemented as a piston. In the closed position of the inlet slide valve 4 illustrated in FIG. 2, an outwardly oriented face 15 of the movable element 13 is then in contact with the pastry mass, when the side 16 of the inlet slide valve facing the cylinder is in contact with the pastry mass residing in the slide valve housing 31. Pressure applied by the pasty mass to the outwardly oriented face 15 of the movable element 13 can then be applied by the movable element 13 to a fluid residing in the entire sealed hollow space 12 and 12*a*. The piston 13 is hereby secured against tilting through guidance in the cover 17 and in the base body 11. The partial spaces 12 and 12*a* are connected with one another by a channel 44*a*.

The entire hollow space 12 and 12*a* is formed by recesses in the base body 11 which are open in the base body 11 towards the side 16 of the inlet slide valve 4 facing the cylinder 1 and have round openings with an opening diameter D1 that is greater than the diameter D2 of the inlet opening 3. The opening of the recess is closed with a cover 17 and with the cutting ring 10 arranged between the outside periphery of the cover 17 and the wall 18 which delimits the opening.

The cutting ring 10, which encompasses the inlet opening in the illustrated closed position of the inlet slide valve 4, is in the configuration illustrated in FIG. 2 pressed with its outwardly oriented face 19 fully against the sealing face 20 surrounding the inlet opening 3 of the body (the slide valve housing) in which the inlet opening 3 is formed. The inwardly oriented face 21 of the cutting ring 10 partially delimits the hollow space.

A low-viscosity grease or a high-viscosity oil is provided in the hollow space 12 and 12*a*. It can be introduced into the hollow space with a grease press through an (unillustrated) inlet opening.

The hollow space of the inlet slide valve 4 also includes a disc spring 22, which presses the movable part 13 constructed as a piston into the hollow space, thereby pre-compressing the fluid in the hollow space. With the generated pre-compression pressure, the fluid in the hollow space exerts a pressure on the inwardly oriented face 21 of the cutting ring 10, thereby pressing the cutting ring 10 with this pressure against the sealing face 20. The contact pressure with which the cutting ring is pressed against the sealing face 20 during the unpressurized switching processes (at "zero pressure") can be adjusted with a suitable selection of the disc spring.

During operation, for example, when according to the method of the invention the pasty mass in the cylinder is compressed before the outlet slide valve 7 is opened, the pasty mass residing in the cylinder is pressed against the face 16 of the inlet slide valve facing the cylinder 1. The same pressure is applied to the face 15 of the movable element 13 facing the cylinder 1. The movable element 13 applies the same pressure to the fluid in the hollow space 12. The cutting ring 10 is then pressed against the sealing face 20 by the pre-bias pressure as well as by the pressure transmitted by the movable element 13. At the same time, the cement paste of the pasty mass presses into the gap between the surface 19 and the sealing face 20 as a hydrodynamic gap pressure, as described in detail in EP 0 057 288 A1. This gap pressure is unable to lift the cutting ring 10 from the sealing face 20 because the hydrodynamic gap pressure is on average only about 50% of the hydrostatic contact pressure exerted by the fluid pressure on the cutting ring. In addition, the cutting ring is sealingly pressed against the sealing face 20 by the disc spring commensurate with the pre-bias.

Figure 3:
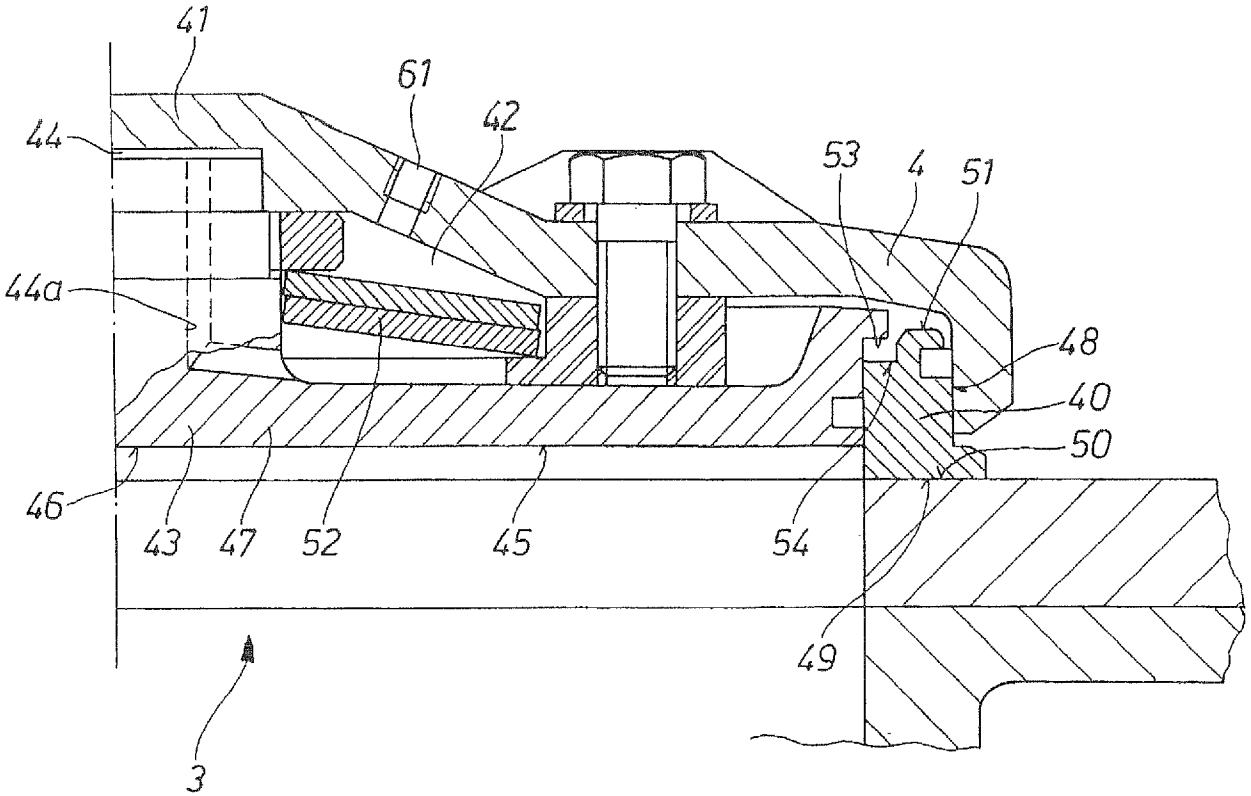
FIG. 3 a detail of an alternative embodiment of an inlet slide valve in a cross-sectional side view.

The embodiment of the inlet slide valve 4 illustrated in FIG. 3 shows that the inlet slide valve 4 can be constructed with a flat base body 41 which can be pivoted about the (unillustrated) pivot axis (in the partial view of half the inlet slide valve illustrated in FIG. 3). The inlet slide valve 4 has an element 43 which is movable relative to the base body 41. In the embodiment illustrated in FIG. 3, this movable element 43 is formed as a cover. The outside diameter of the movable element 43 delimits a hollow space, with the diameter of the hollow space corresponding to the inside diameter of the cutting ring 10. The bore 44 is provided for guiding the movable element without the risk of canting. The space 44 is connected with the remaining hollow space via the channel 44*a*. When the inlet slide valve 4 illustrated in FIG. 3 is in the closed position, an outwardly oriented face 45 of the movable element 43 is in contact with the pasty mass, when the slide 46 of the inlet slide valve 4 facing the cylinder is in contact with the pasty mass residing in the slide valve housing 31. The movable element 43 can then apply to a fluid residing in the hollow space 42 a pressure equal to the pressure applied by the pasty mass on the outwardly oriented face 45 of the movable element 43.

The hollow space 42 is formed by a recess in the hollow body 41 which is open in the base body 41 towards the side 46 of the inlet slide valve 4 facing the cylinder 1. For forming the hollow space 42, the opening of the recess is closed by the movable piston 43 embodied as a cover 47 and the cutting ring 40 arranged between the outside perimeter of the cover 47 and the wall 48 delimiting the opening.

In the design illustrated in FIG. 3, the outwardly oriented face 49 of the cutting ring 40, which encompasses the inlet opening in the illustrated closed position of the inlet slide valve 4, is completely pressed against a sealing face 50 surrounding the inlet opening 3 of the body in which the inlet opening 3 is formed (the orifice plate of the slide valve housing). The inwardly oriented face 51 of the cutting ring 40 partially delimits the hollow space 42.

A low-viscosity grease or a high-viscosity oil is provided in the hollow space 42. This can be introduced into the hollow space 42 through the inlet opening with a grease press.

The inlet slide valve 4 has also one or more disc springs 52, which press the "movable" piston 43 constructed as a cover 47 into the hollow space 42, thereby pre-compressing the fluid in the hollow space. With the pre-compression pressure, the fluid in the hollow space 42 exerts pressure on the inwardly oriented face 51 of the cutting ring 40 and presses the cutting ring 40 with this pressure against the sealing face 20 during an unpressurized switching operation. The contact pressure with which the cutting ring is pressed against the sealing face 50 during the switching operation can be adjusted by suitable selection of the disc spring 52.

In the alternative design of an inlet slide valve 4 illustrated in FIG. 3, the movable element is completely formed by the cover 47. The movable element applies a pressure to a fluid residing in the hollow space 42 of the base body 41 which corresponds to the pressure applied to it by the pasty mass. The cover 47 is movable relative to the base body 41. The cover 47 has a limit stop 43 in contact with a limit stop 54 of the cutting ring 40 when the cover is pushed outward by the fluid in the hollow space. An operating situation is illustrated in FIG. 3 where the limit stop 53 is not in contact with the limit stop 54, but is located at the opposite end of the travel path. Both limit stops should be avoided during operation. For this reason, more fluid must be added here (FIG. 3).

Figure 4:
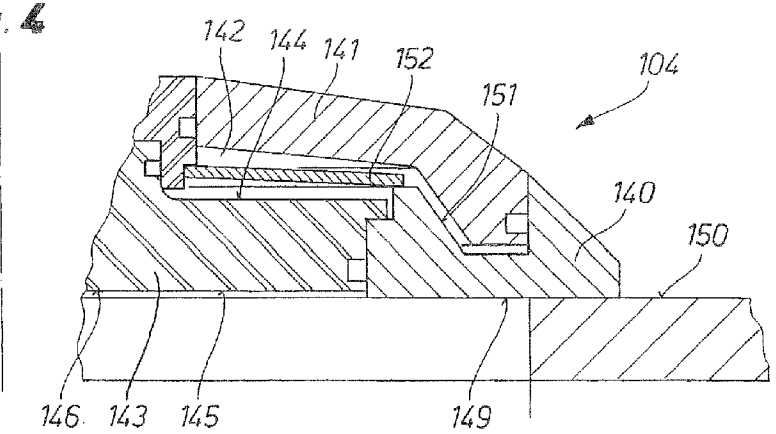
FIG. 4 a detail of an additional embodiment of the inlet slide valve in a cross-sectional side view.

In the alternative embodiment illustrated in FIG. 4, components identical to those illustrated with reference to the embodiment in FIG. 3 have reference numbers incremented by 100. In the embodiment of FIG. 4 the shape of the cutting ring 140 and the support of the spring element 152 differ from the embodiment of FIG. 3. The spring element is in this embodiment supported on the cutting ring and not—as in the embodiment of FIG. 3—on a separate component that is fixedly connected with the base body. Moreover, the cutting ring 140 is constructed as an annular piston having a U-shaped annular cross-section, which is slidingly sealed with its outer inside diameter against the base body 141 and with its inner inside diameter against the piston 143.

The side of the piston 143 facing the fluid includes a substantially cylindrical shaft which is slidingly supported in a cylindrical bore of the housing and which in conjunction with the envelope of the piston forms a guide which prevents the piston from canting. This shaft of the piston penetrates the base body for axial movement therein and is sealed.

The structure of the base body 141 illustrated in FIG. 4 and of the cutting ring 140 is outwardly tapered and hence allows stones to climb up, should these stones block the pivoting motion of the slide valve.

Figure 5:
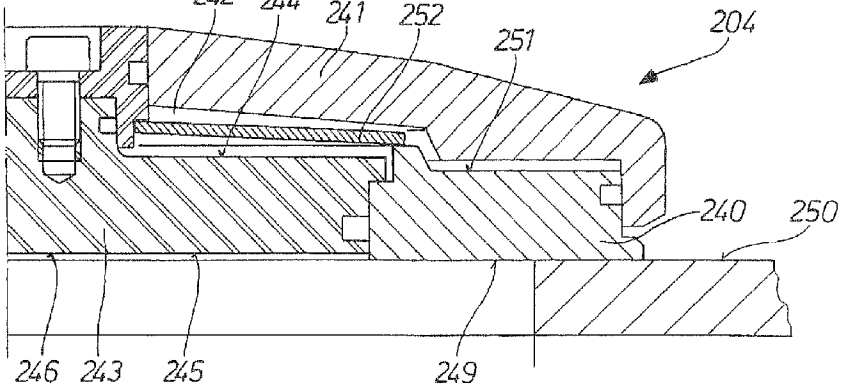
FIG. 5 a detail of an additional embodiment of the inlet slide valve in a cross-sectional side view.

In the alternative embodiment illustrated in FIG. 5, components identical to those illustrated with reference to the embodiment in FIG. 3 have reference numbers incremented by 200. The embodiment of FIG. 5 differs from the embodiment illustrated in FIG. 4 in the shape of the cutting ring 240 and in that the base body 241 encompasses the outside of the cutting ring 240.

What is claimed is:

1. A method for feeding pasty masses with a pump device having a piston pump with at least two cylinders, each cylinder having a piston, wherein each of the at least two cylinders is connected with a pre-fill container via a respective inlet opening that can be closed with a respective inlet slide valve associated with the corresponding cylinder and wherein each of the at least two cylinders is connected with a feed line via a respective outlet opening that can be closed with a respective outlet valve associated with the corresponding cylinder, the outlet valves being rotary slide valves, each with a valve body in a valve housing, wherein the valve housing is within a feed space through which pasty mass is transported from the corresponding cylinder into the feed line and the valve body remains in the valve housing in all positions of the outlet valve, the method comprising the steps of:

transporting pasty mass during a suction stroke of one of the at least two cylinders from the pre-fill container into the one cylinder when the inlet opening of the one cylinder is open and the outlet opening of the one cylinder is closed, closing the inlet opening of the one cylinder with the inlet slide valve of the one cylinder at the end, close to the end or shortly after the end of the suction stroke of the one cylinder, compressing the pasty mass in the one cylinder with both the inlet opening and the outlet opening of the one cylinder closed until the pasty mass in the one cylinder through compression against the closed outlet opening reaches substantially an actual feed pressure created by a pump stroke of the other of the at least two cylinders occurring during the suction stroke and this compression step of the one cylinder, opening the outlet opening of the one cylinder, without a volume change in the feed space, the rotary slide valve remaining in the feed space, transporting the pasty mass during a pump stroke of the one cylinder from the one cylinder into the feed line with the outlet opening of the one cylinder open and the inlet opening of the one cylinder closed, the pump stroke of the one cylinder occurring during a corresponding suction stroke and compression step of the other cylinder, wherein a velocity of the pistons during the respective suction strokes is greater than a velocity of the pistons during the respective pump strokes.

2. The method of claim 1, wherein the valve body of the rotary slide valve of the one cylinder is moved from a closed position into an open position, when pressure of the pasty mass in the one cylinder during compression of the pasty mass is substantially equal to pressure of the pasty mass on the feed-line-side of the rotary slide valve.

3. The method of claim 1, wherein the inlet slide valves are pivoting flat slide valves.

4. The method of claim 1, wherein the inlet slide valves each comprise a pre-biased spring element which operates on a valve piston in an identical direction as the pressure from the pasty masses in the respective cylinders.

5. The method of claim 4, wherein the spring element is formed by one or more disc springs.

6. The method of claim 4, wherein the valve piston has on a side facing the pasty mass a substantially cylindrical shaft which is slidingly supported in a cylindrical bore of a base body and which, in conjunction with an envelope of the piston, forms a guide that secures the valve piston against canting.

7. The method of claim 6, wherein the shaft of the valve piston sealingly extends through the base body and is axially movable therein.

8. The method of claim 4, wherein the spring element is supported on a cutting ring.

* * * * *